US009849486B2

(12) United States Patent
Massman et al.

(10) Patent No.: US 9,849,486 B2
(45) Date of Patent: Dec. 26, 2017

(54) VIBRATORY APPARATUS WITH MULTIPLE SCREENING DECKS

(71) Applicant: General Kinematics Corporation, Crystal Lake, IL (US)

(72) Inventors: Steve Massman, Poplar Grove, IL (US); Eric Dickinson, Crystal Lake, IL (US)

(73) Assignee: General Kinematics Corporation, Crystal Lake, IL (US)

( * ) Notice: Subject to any disclaimer, the term of this patent is extended or adjusted under 35 U.S.C. 154(b) by 0 days.

(21) Appl. No.: 14/957,334

(22) Filed: Dec. 2, 2015

(65) Prior Publication Data

US 2016/0158805 A1 Jun. 9, 2016

Related U.S. Application Data

(60) Provisional application No. 62/088,492, filed on Dec. 5, 2014.

(51) Int. Cl.
*B07B 1/28* (2006.01)
*B07B 1/46* (2006.01)

(52) U.S. Cl.
CPC ..... *B07B 1/46* (2013.01); *B07B 1/28* (2013.01); *B07B 1/4609* (2013.01); *B07B 2201/04* (2013.01)

(58) Field of Classification Search
CPC ..... B07B 1/28; B07B 1/46; B07B 2201/04
USPC ..... 209/314–317
See application file for complete search history.

(56) References Cited

U.S. PATENT DOCUMENTS

| | | | | |
|---|---|---|---|---|
| 19,175 A | | 1/1858 | Hoyt et al. | |
| 1,415,610 A | * | 5/1922 | Palmer | A01F 11/00 209/254 |
| 2,329,333 A | * | 9/1943 | Carter | B01D 35/20 209/314 |
| 2,386,579 A | * | 10/1945 | Wheeler | B07B 1/286 209/314 |

(Continued)

FOREIGN PATENT DOCUMENTS

| | | |
|---|---|---|
| DE | 4210881 | 10/1993 |
| WO | WO 94/26427 | 11/1994 |

OTHER PUBLICATIONS

European Search Report, counterpart EP Appl. No. 15198016, dated Apr. 4, 2016.

*Primary Examiner* — Joseph C Rodriguez
(74) *Attorney, Agent, or Firm* — Cook Alex Ltd.

(57) ABSTRACT

A vibratory apparatus includes a deck assembly with a longitudinal axis, an inlet end, and an outlet end. The deck assembly includes a plurality of deck sections each having a plurality of openings. Each deck section has upstream and downstream edges, the downstream edge of each successive deck section disposed closer longitudinally to the outlet end than the downstream edge of each preceding deck section. The upstream edge of each successive deck section is disposed closer longitudinally to the upstream edge of each preceding deck section than the downstream edge of the preceding deck section is disposed to the upstream edge of the preceding deck section, thereby defining an overlapping portion of the preceding deck section and a non-overlapping portion of the preceding deck section. The overlapping portion has larger openings than the non-overlapping portion for each preceding deck section.

6 Claims, 3 Drawing Sheets

(56) References Cited

U.S. PATENT DOCUMENTS

| | | | | | |
|---|---|---|---|---|---|
| 3,285,413 | A | | 11/1966 | Taylor-Smith | |
| 3,302,788 | A | | 2/1967 | Sackett, Jr. | |
| 3,622,089 | A | * | 11/1971 | Quinn | B02C 21/02 209/315 |
| 4,306,974 | A | * | 12/1981 | Harry | B01D 35/20 209/269 |
| 4,627,576 | A | * | 12/1986 | Hahn | B07B 13/18 241/24.1 |
| 4,634,535 | A | * | 1/1987 | Lott | B01D 21/00 209/311 |
| 5,137,621 | A | * | 8/1992 | Brown | B07B 1/15 209/234 |
| 5,614,094 | A | * | 3/1997 | Deister | B01D 33/015 209/250 |
| 5,641,070 | A | * | 6/1997 | Seyffert | B01D 33/0346 209/314 |
| 6,135,020 | A | * | 10/2000 | Broyles | A23N 5/01 426/481 |
| 6,352,159 | B1 | * | 3/2002 | Loshe | B01D 33/0353 209/268 |
| 6,439,391 | B1 | * | 8/2002 | Seyffert | B07B 1/48 209/11 |
| 6,715,611 | B2 | * | 4/2004 | Crabbe | B01D 33/033 209/309 |
| 6,820,748 | B2 | * | 11/2004 | Fallon | B07B 1/46 209/311 |
| 6,868,972 | B2 | * | 3/2005 | Seyffert | B01D 33/0376 209/254 |
| 7,198,156 | B2 | * | 4/2007 | Schulte | B01D 33/033 209/267 |
| 8,863,959 | B1 | * | 10/2014 | Britton | B07B 1/28 209/11 |
| 9,427,781 | B2 | * | 8/2016 | Dickinson | B07B 1/44 |

* cited by examiner

VIBRATORY APPARATUS WITH MULTIPLE SCREENING DECKS

BACKGROUND

This patent is directed to a vibratory apparatus with multiple decks and a method for operating such a vibratory apparatus, and, in particular, to a vibratory screening apparatus with multiple screening decks and a method for use of the same.

It is common to have a multi-deck screening apparatus, with each successive screening deck described as being above the preceding deck, and the surface of each lower deck being completely covered by the deck immediately above that lower deck, from inlet to outlet of the apparatus. The largest material flows over the uppermost deck from the inlet to the outlet, while smaller material flows through the uppermost deck to the next lowest deck. This process repeats until the smallest material passes through the lowestmost deck out of the apparatus, or to a floor and then along the floor and out of the apparatus. The material that does not pass through a particular screening deck may be collected at the outlet end of that screening deck.

One disadvantage of such a screening apparatus is that to clean, repair or replace the lowermost deck, or any of the intermediate decks, one must first remove the upper decks. Moreover, it is not possible to visualize from above the motion of the material across the lowermost deck, for example, because of the intermediate decks. Of course, while a screening apparatus having a single deck would avoid these disadvantages, such a solution avoids disadvantages of a multi-deck screening apparatus while also losing the advantages of a multi-deck screening apparatus.

SUMMARY

According to one aspect of the present disclosure, a vibratory apparatus includes a deck assembly and an exciter coupled to the deck assembly. The deck assembly has a longitudinal axis, an inlet end, and an outlet end spaced from the inlet end along the longitudinal axis. The deck assembly includes a plurality of deck sections each having a plurality of openings therethrough. Each deck section has an upstream edge and a downstream edge disposed transversely relative to the longitudinal axis, the upstream edge disposed closer longitudinally to the inlet end and the downstream edge disposed closer longitudinally to the outlet end. The downstream edge of each successive deck section is disposed closer longitudinally to the outlet end than the downstream edge of each preceding deck section. The upstream edge of each successive deck section is disposed closer longitudinally to the upstream edge of each preceding deck section than the downstream edge of the preceding deck section is disposed to the upstream edge of the preceding deck section, thereby defining an overlapping portion of the preceding deck section and a non-overlapping portion of the preceding deck section. The overlapping portion has larger openings than the non-overlapping portion for each preceding deck section.

BRIEF DESCRIPTION OF THE DRAWINGS

It is believed that the disclosure will be more fully understood from the following description taken in conjunction with the accompanying drawings. Some of the figures may have been simplified by the omission of selected elements for the purpose of more clearly showing other elements. Such omissions of elements in some figures are not necessarily indicative of the presence or absence of particular elements in any of the exemplary embodiments, except as may be explicitly delineated in the corresponding written description. None of the drawings are necessarily to scale.

DETAILED DESCRIPTION OF VARIOUS EMBODIMENTS

Figure 1:
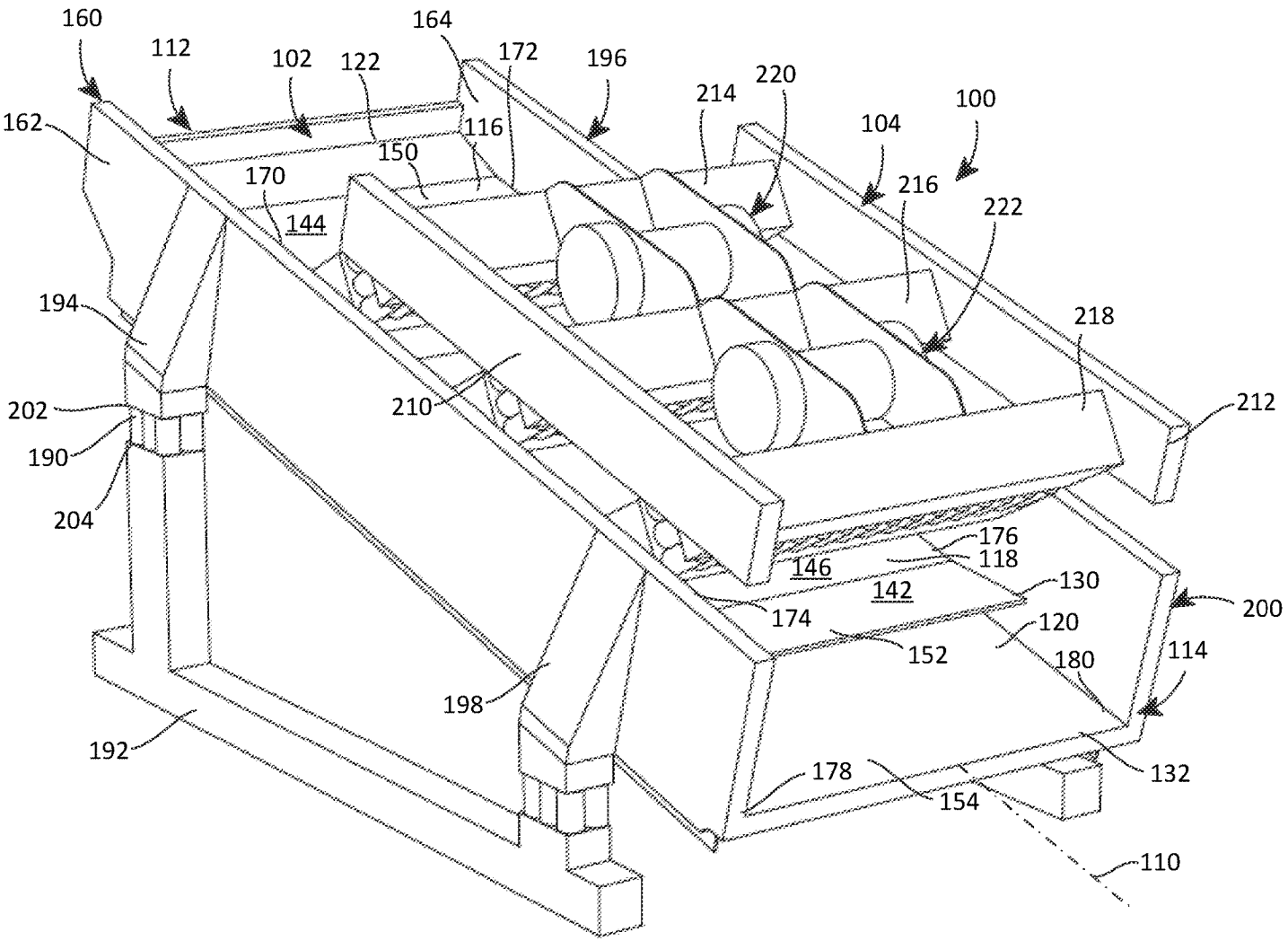
FIG. 1 is a perspective view of a vibratory apparatus, and in particular a vibratory screening apparatus, as viewed from an outlet end and having multiple decks or deck sections.
Figure 2:
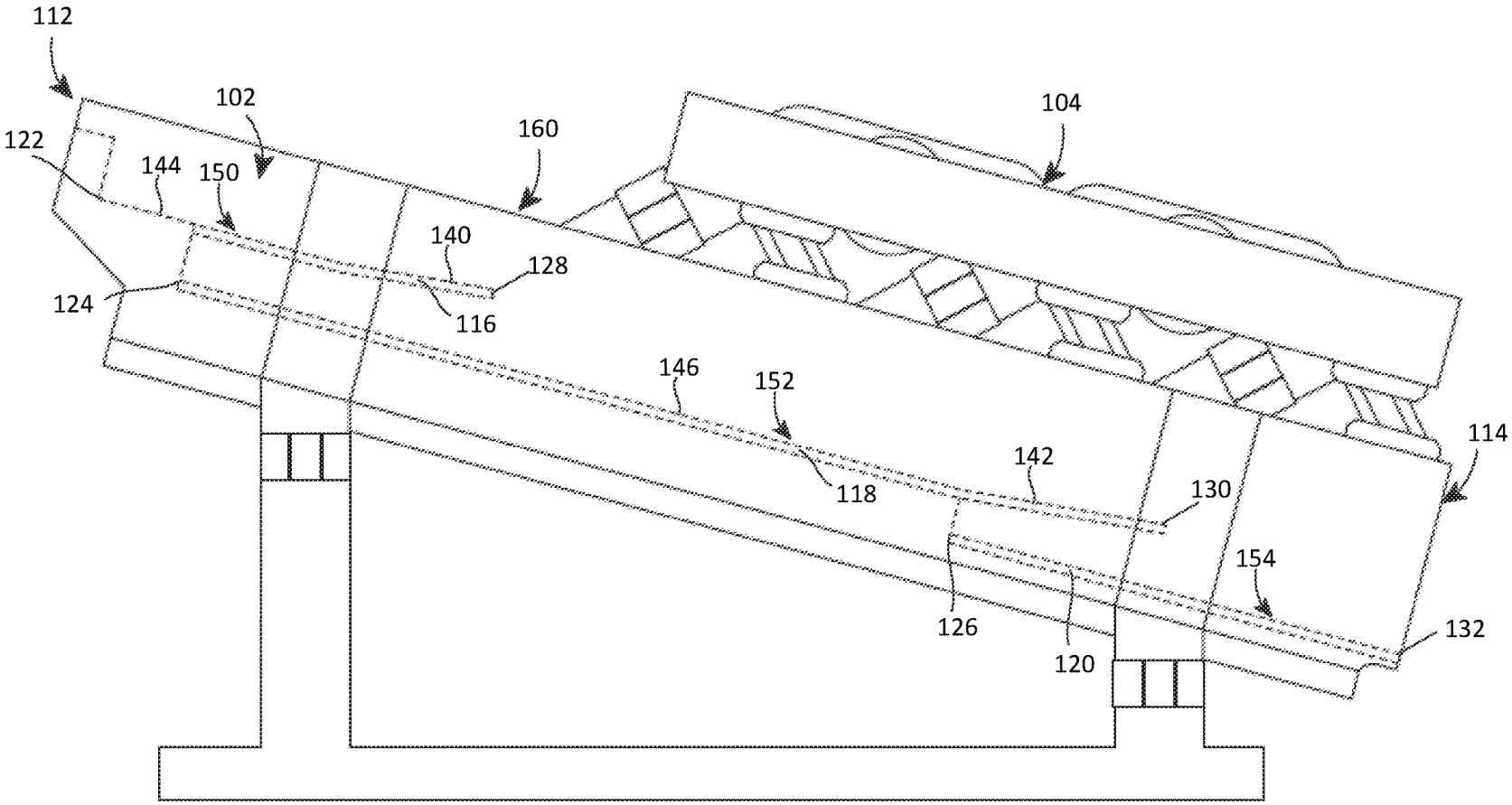
FIG. 2 is a side view of the vibratory apparatus of FIG. 1.
Figure 3:
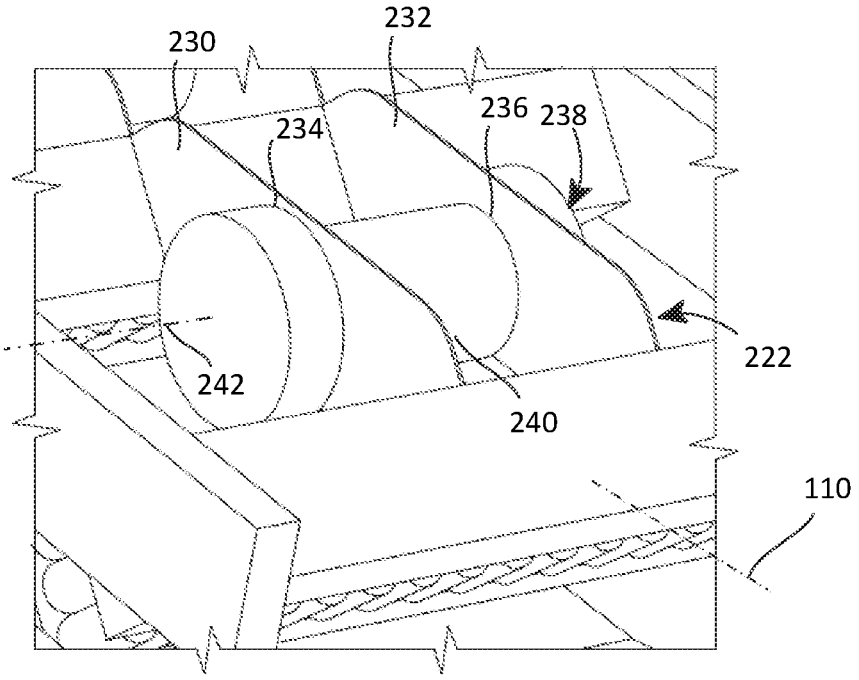
FIG. 3 is an enlarged, perspective view of a portion of the exciter of the apparatus of FIG. 1.

FIGS. 1-3 illustrate a vibratory apparatus 100, in the form of a vibratory screening apparatus, screener, or screen. The screen 100 includes a deck assembly 102 and an exciter 104 coupled to the deck assembly 102.

As illustrated, the vibratory screen 100 is a two-mass, sub-resonant frequency design. That is, the exciter 104, or first mass, is used to drive the deck assembly 102, or second mass, and thus the screen 100 may be referred to as a two-mass unit. One advantage of using a two-mass configuration is that the two-mass configuration responds positively to loading. That is, as the loading increases, the screen 100 will actually provide an increase in stroke, rather than a reduction in stroke (or dampening). As such, a two-mass screen of lower power requirements may be used in place of a direct-drive or brute force unit to process a similar loading, or a two-mass screen of similar power requirements may be used to process a much larger load. However, according to other embodiments of the present disclosure, a direct-drive or brute force unit may be used instead. The details of one embodiment of the exciter 104 will be discussed below.

In general, the deck assembly 102 has a longitudinal axis 110 (see FIG. 1). The assembly 102 also has an inlet end 112 and an outlet end 114. The outlet end 114 is spaced from the inlet end 112 along the longitudinal axis 110 of the deck assembly 102, with the inlet and outlet ends 112, 114 being opposite ends of the assembly 102. While the end 112 is referred to as the inlet, and the end 114 is referred to as outlet, it will be recognized that because the deck assembly 102 may have openings throughout, material will be exiting the deck assembly 102 between the inlet end 112 and the outlet end 114. However, the general motion of material across the deck assembly 102 is from inlet end 112 to outlet end 114 according to the operation of the exciter 104.

The deck assembly 102 includes a plurality of deck sections. As best seen in FIG. 2, the illustrated embodiment has a deck assembly 102 with three deck sections 116, 118, 120. The deck sections 116, 118, 120 each have a plurality of openings therethrough, although the openings may not be of the same size for all portions of the deck sections 116, 118. It will be recognized that a greater number of deck sections may be included, or two deck sections may define the deck assembly 102.

Furthermore, it will be recognized that the screen 100 may include additional deck sections or portions of deck sections that do not define part of the deck assembly 102. For example, there may be deck sections that precede (i.e., before section 116) or succeed (i.e., after section 120) the deck assembly 102 that do not include the features of the deck sections 116, 118, 120 that cause the deck sections 116, 118, 120 to be considered to be part of the deck assembly 102.

Each deck section 6, 118, 120 has an upstream edge 122, 124, 126 and a downstream edge 128, 130, 132 disposed transversely relative to the longitudinal axis 110. In so describing the edges 122, 124, 126 and 128, 130, 132, it is not intended that the transverse nature of the edges relative to the longitudinal axis 110 limit the edges to a perpendicular orientation relative to the longitudinal axis 110, although that is the orientation as illustrated. Instead, it is intended that "transverse" include edges that are at an angle to the longitudinal axis 110, and as such may be orthogonal to the longitudinal axis 110 according to particular embodiments (such as the embodiment illustrated).

The upstream edge 122, 124, 126 of each deck section 116, 118, 120 is disposed closer longitudinally to the inlet end 112, and the downstream edge 128, 130, 132 is disposed closer longitudinally to the outlet end 114. That is, the upstream edge 122, 124, 126 is in the direction of the inlet end 112, and the downstream edge 128, 130, 132 is in the direction of the outlet end 114.

The downstream edge 130, 132 of each successive deck section 118, 120 is disposed closer longitudinally to the outlet end 114 than the downstream edge 128, 130 of each preceding deck section 116, 118. It will be recognized that how much closer the edge 130, for example, is to the outlet end 114 than the edge 128 will depend on the length of the sections 116, 118, as well as the relative position of the upstream edges 122, 124 of the sections 116, 118.

In that regard, the upstream edge 124, 126 of each successive deck section 118, 120 is disposed closer longitudinally to the upstream edge 122, 124 of the preceding deck section 116, 118 than the downstream edge 128, 130 of the preceding deck section 116, 118 is disposed to the upstream edge 122, 124 of the preceding deck section 116, 118. In other words, the upstream edge 124, 126 of each successive deck section 118, 120 is disposed between the upstream edge 122, 124 and the downstream edge 128, 130 of the preceding deck section 116, 118 when viewed from above, although the deck sections 116, 118, 120 themselves are spaced apart in an axis that lies in the plane of the drawing page, and which will be referred to herein as the elevation axis, or elevation for short.

The relative position of the upstream and downstream edges described in the preceding paragraph defines an overlapping portion 140, 142 for each preceding deck 116, 118 and a non-overlapping portion 144, 146. As illustrated, the overlapping portions 140, 142 have larger openings than the non-overlapping portions 144, 146 for each preceding deck section 116, 118 (in the case of non-overlapping portion 144, there may be no openings at all, such that the openings of overlapping portion 140 may still be referred to as larger in size). In fact, the overlapping portions 140, 142 may also have larger openings than at least a region of the successive decks 118, 120 immediately below the overlapping portions 140, 142. As will be explained below, the relative size of the openings may be discussed in terms of a minor dimension, although in other cases it may be more convenient to discuss the relative size of the openings in terms of area encompassed by the edge of the opening, for example.

The screen 100 as previously described has a number of advantages over conventional screens, which have a first deck that extends from the inlet end to the outlet end disposed at a higher elevation relative to a second deck that also extends from the inlet end to the outlet end. By arranging the deck sections 116, 118, 120 as described above, a significant portion of an upper surface 150, 152, 154 of each deck section 116, 118, 120 is accessible and visible without having to access or move other deck sections 116, 118, 120. This arrangement provides for ease of viewing, ease of cleaning, and ease of replacement. Furthermore, if other materials are to be added to the material traveling over the surfaces 150, 152, 154, such as water for example, then the access provided by this arrangement also facilitates that activity as well.

Furthermore, the screen 100 as described above has a number of advantages over a single deck. To begin, the deck assembly 102 may provide more deck area and improved efficiency relative to a single deck. Furthermore, the changes in elevation between the deck sections 116, 118, 120 may create a cascading, tumbling effect in the material passing over the deck assembly 10 between the inlet end 112 and the outlet end 114. This cascading effect may also increase screening efficiency relative to a single deck, for example by permitting the material to remix at each transition of the deck assembly 102 to allow the material to remove itself from suspension within the material bed and flow through the deck openings or present itself repeatedly to the deck openings. This may also provide a scrubbing effect that limits or prevents binding within the material on the surfaces 150, 152, 154. Of course, the cascading motion of the material between deck sections 116, 118, 120 may require reinforcement of the deck sections 116, 118, 120 in those regions of the deck sections 118, 120 that receive the material from preceding sections 116, 118.

Having thus described the screen 100 in general terms, the details of the screen 100 are provided below.

The screen 100, as illustrated, is symmetrical about the longitudinal axis 110 that extends from the inlet end 112 to an outlet end 114. Consequently, each side is a mirror image of the other side view. For purposes of convenience only, only one side view is provided, viewed from the right hand side of the screen 100 as defined from the inlet end 112 in the direction of the outlet end 114.

The screen 100 includes a trough 160 in which the deck assembly 102 may be disposed. The trough 160 may include side walls 162, 164 (see FIG. 1), the side walls 162, 164 being parallel to the longitudinal axis 110. Each of the deck sections 116, 118, 120 has first side edges 170, 174, 178, and second side edges 172, 176, 180, each of which may be parallel to the longitudinal axis 110. As illustrated, the first side edges 170, 174, 178 may be attached to the side wall 162, and the second side edges 172, 176 180 may be attached to the side wall 164. In particular, the edges 170, 174, 178 may be attached to an inner surface of the side wall 162, while the edges 172, 176, 180 may be attached to an inner surface of the side wall 164.

According to certain embodiments, there may be an intermediate wall that divides the decks 116, 118, 120 into first and second regions that extend between the inlet and outlet ends 112, 114, In fact, the decks 116, 118, 120 may be divided into first and second subdecks, the first subdeck defining the first region and the second subdeck defining the second region, and the first and second subdecks being attached at first edge to either the side wall 162 or the side wall 164 and at a second edge to the intermediate wall. The first and second regions may be referred to as the right and left regions, as observed from the inlet end 112 in the direction of the outlet end 114.

As noted above, each of the deck sections 116, 118, 120 has at least a first portion that has a plurality of apertures or openings formed therethrough. This region of the deck sections 116, 118, 120 may also be referred to as foraminous, and the deck sections 118, 120 may be referred to as a foraminous deck sections, while deck section 116 may be referred to as a partially foraminous deck section. The apertures or openings may have a circular shape, but the shape of the aperture is not limited to such a shape. For example, the apertures may be in the form of an elongated slot, having a major axis and a minor axis with rounded ends at either end of the major axis. Such elongated apertures may be aligned with the longitudinal axis 110, or may be transverse to the longitudinal axis 110; in fact, the apertures may alternate their angle relative to the longitudinal axis along different rows of apertures that are generally aligned with the longitudinal axis 110, similar to a herringbone pattern.

Whether the shape of the aperture is circular or non-circular (such as the slot described above), the aperture may be described as having a minor dimension. The minor dimension may be the diameter of a circular aperture (where there is only a single dimension), or the minor axis of an elongated slot-like aperture. Either event, according to certain embodiments, the minor dimension of the apertures or openings of the overlapping sections 140, 142 may be 18 mm, while the minor dimension of the openings of the non-overlapping section 146 and of the openings in the deck section 120 may be 2.2 mm. As such, the openings of the overlapping portions 142 of the deck section 118 may have a minor dimension that is at least five, six, seven, or eight times greater than a minor dimension of the openings of the non-overlapping portion 146 of the deck section 118.

According to the illustrated embodiment, the non-overlapping portions 144, 146 are planar and at least a region of the overlapping portions 140, 142 are also planar. That is, the plate or other structure that defines each of the portions 140, 142, 144, 146 of deck sections 116, 118 lies within a given plane. This is not to suggest that the portions 140, 142, 144, 146 may not have localized regions that do not lie within the plane, but that the majority of the region described lies within a given plane. This description also does not exclude the possibility of structures being attached to the surfaces 150, 152, 154, such that the structures project or extend from the surfaces 150, 152, 154.

The overlapping portions 140, 142 or regions thereof just described may extend at an angle to a plane in which the non-overlapping portion 144, 146 is disposed. For example, the overlapping portion 142 of the deck section 118 may extend at an angle to a plane in which the non-overlapping portion 146 of the deck section 118 is disposed. It may also be described that the downstream edges 120, 130 are turned up relative to the upstream edges 122, 124. As illustrated, the angle is an acute angle of less than 10 degrees, and because of the relatively steep angle of the outlet end 114 relative to the inlet end 112, the downstream edges 128, 130 are at a lower elevation relative to the upstream edges 122, 124 even though the overlapping and non-overlapping portions are disposed at an angle to each other. Still, it is believed that the angle of the overlapping portions 140, 142 relative to the non-overlapping portions 144, 146 may retard the movement of the material across the surfaces 150, 152, which delay may increase the depth of the material on those surfaces 150, 152 and may increase the dwell time of the material on those surfaces 150, 152.

The deck section 116 may have portion that does not have any apertures, holes, etc., such as the non-overlapping region 144. This initial region may be used to receive the material that will be passed over the deck sections 116, 118, 120. The initial region may be inclined relative to the remainder of the deck sections 116, 118, 120 so as to encourage the material disposed on the initial region to move from the initial region to the remainder of the deck sections 116, 118, 120.

The deck sections 116, 118, 120 may have a liner disposed on a transporting surface thereof. The liner may include multiple plates, and may define, at least in part, the openings or apertures that pass through the deck assembly 102, for example. In one exemplary embodiment, the liner may be used to increase the resistance of the deck sections 116, 118, 120 to wear.

The trough 160 may also include or more crossbeams or pairs of crossbeams that are attached to and depend between the side wall 162, 164. In an embodiment of the apparatus where the trough 160 includes an intermediate wall, the crossbeams may be attached to the intermediate wall well. According to certain embodiments, there are two pairs of crossbeams adjacent the inlet end 112 and a further pair at the outlet end 114. The crossbeams would be spaced from the surfaces 150, 152, 154 of the deck sections 116, 118, 120 so as to permit material to move freely along the surfaces 150, 152, 154.

The deck assembly 102 is supported by resilient members (e.g., coil springs, also referred to as isolation springs) 190 on a frame 192. The frame 192 is disposed on a foundation, which may be the ground story of a building or which may be an upper story of such a structure; in fact, vibratory screening units are typically mounted at the uppermost levels of the buildings in a mining processing plant, which elevations can exacerbate issues with the vibrations generated by such screens. The resilient members or isolation springs 190 act to isolate the screen 100 from the foundation. That is, the resilient members 190 act to minimize the transmission of the dynamic forces generated during operation of the screen 100 to the frame 192 and the underlying foundation.

More specifically, the isolation springs 190 are attached to the trough 160, which is in turn attached to the deck assembly 102 as described above. The trough 160 may further include one or more mounting brackets 194, 196, 198, 200. The mounting brackets 194, 198 may be joined or attached to an outer surface of the side wall 162, while the mounting brackets 196, 200 are joined or attached to an outer surface of the side wall 164. The isolation springs 190 are attached at a first end 202 to one of the mounting brackets 194, 196, 198, 200 and at a second end 204 to the frame 192.

As mentioned above, the apparatus 100 also includes the exciter 104. The exciter 104 is coupled to the trough 160 (and the deck assembly 102) via the links and reactor springs. In particular, the exciter 104 is supported on the first and second side walls or sides 162, 164 of the trough 160. The details of the exciter 104 are now discussed with reference first to FIG. 1.

The exciter 104 includes a frame with first and second side walls 210, 212 parallel to the longitudinal axis 110. The exciter 104 also includes three crossbeams 214, 216, 218 that are connected at opposite ends to an inner surface of the side walls 210, 212. The exciter 104 further includes two motor mounts 220, 222 that are attached to the crossbeams 214, 216, 218. As illustrated, the motor mount 220 is attached to and depends between the crossbeams 214, 216, and the motor mount 222 is attached to and depends between the crossbeams 216, 218. The motor mounts 220, 222 are attached to and depend between the crossbeams 214, 216, 218 at the midpoints of the crossbeams 214, 216, 218 (i.e., along the longitudinal axis 110 of the apparatus 100).

The details of the motor mounts 220, 222 are now explained with reference to the motor mount 222 and FIG. 3, although a similar explanation would be applicable to the motor mount 220. The motor mount 222 includes first and second mounting plates 230, each of which includes an opening 234, 236 for a motor assembly 238. The motor assembly 238 includes a motor 240 with a shaft disposed along an axis 242. The axis 242 of the motor 240 intersects the axis 110 of the apparatus 100 at an angle as viewed from above; as illustrated, the axes 110, 242 intersect at a right angle (i.e., the axes are orthogonal). The axis 242 may also be described as transverse to the longitudinal axis 110 according to the definition provided above. A pair of eccentric weights is attached at either end of the motor shaft, and rotates about the axis 242.

As mentioned previously, the exciter 104 (or more particularly, the side walls 210, 212 or crossbeams 214, 216, 218 of the exciter 104) are attached to the deck sections 116, 118, 120 (or more particularly, the side walls 162, 164 of the trough 160) via the links and reactor springs as illustrated in FIG. 2. In particular, the links and springs may be grouped into pairs, with each pair of links and springs inclined at opposing angles to the horizontal (for example, the links may form an obtuse angle with the horizontal, while the paired springs may form an acute angle with the horizontal). The links may be attached at a first end to the exciter 104 and a second end to the trough 160, while the springs may be attached at a first end to the exciter 104 and a second end to the trough 160. As such, the first side 162 is coupled to the first side 210 and the second side 164 is coupled to the second side 212 through the links and springs.

In operation, material is introduced into the screen 100 at the inlet end 112. With the exciter 104 activated, the material passes over the surfaces 150, 152, 154 between the inlet end 112 and the outlet end 114. Because of the inclination of the screen 100 between the inlet end 112 and the outlet end 114, gravity may also assist in the motion of the material over the surfaces 150, 152, 154 and between the deck sections 116, 118, 120.

Material that is larger than the apertures may pass along the deck section 116 from the inlet end 112 to the downstream edge 128, while material that is smaller than the apertures may fall through the deck section 116. In particular, certain material may pass through the overlapping portion 140 of the deck section 116 and onto the deck section 118, while other larger material may pass over the downstream edge 128 of the deck section 116. Material that is larger than the apertures of deck section 118 may pass along the deck section 118 from the upstream edge 124 to the downstream edge 130 at least until the overlapping section 142, while material that is smaller than the apertures may fall through the deck section 118 and out of the screener or onto a floor of the trough 160. Again, a fraction of the larger material may pass through the overlapping portion 142 of the deck section 118 and onto the deck section 120, while other larger material may pass over the downstream edge 130 of the deck section 118. The material passing through or over the overlapping portion 142 may then pass along the deck section 120 and either through the deck section 120 or to the outlet end 114.

Embodiments of the screen 100 may include one or more of the following advantages. As mentioned above that the screen 100 may facilitate viewing of the material passing through the screen 100 between the inlet and outlet ends 112, 114, as well as cleaning and repair/replacement of the deck sections 116, 118, 120. The structure of the screen may also facilitate introduction of material to the screen 100. Moreover, the screen 100 (and more particular the deck assembly 102) achieves this while improving the efficiency of the screen through the cascading, tumbling action of the material through the screen 100.

Although the preceding text sets forth a detailed description of different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done fir sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112.

What is claimed is:

1. A vibratory apparatus comprising:

a trough;

a deck assembly disposed in the trough and having a longitudinal axis, an inlet end, and an outlet end spaced from the inlet end along the longitudinal axis, and the trough including first and second side walls parallel to the longitudinal axis, the deck assembly comprising a plurality of deck sections each having a plurality of openings therethrough, each deck section having first and second side edges parallel to the longitudinal axis, the first side of each of the deck sections attached to the first side wall and the second side edge of each of the deck sections attached to the second side wall;

each deck section having an upstream edge and a downstream edge disposed transversely relative to the longitudinal axis, the upstream edge disposed closer longitudinally to the inlet end and the downstream edge disposed closer longitudinally to the outlet end, the downstream edge of each successive deck section disposed closer longitudinally to the outlet end than the downstream edge of each preceding deck section, the upstream edge of each successive deck section disposed closer longitudinally to the upstream edge of each preceding deck section than the downstream edge of the preceding deck section is disposed to the upstream edge of the preceding deck section, thereby defining an overlapping portion of the preceding deck section and a non-overlapping portion of the preceding deck section, the overlapping portion having larger openings than a region of the successive deck immediately below the overlapping portion; and the overlapping portion having larger openings than the non-overlapping portion for each preceding deck section;

an exciter coupled to the deck assembly, the exciter having first and second sides, with the first side of the exciter coupled to the first side wall of the trough through a plurality of links and reactor springs, and the second side of the exciter is coupled to the second side wall of the trough through a plurality of links and reactor springs.

2. The vibratory apparatus according to claim 1, wherein the openings of the overlapping portion of at least one deck section have a minor dimension at least five times greater than a minor dimension of the openings of the non-overlapping portion of the at least one deck section.

3. The vibratory apparatus according to claim 2, wherein the minor dimension of the openings of the overlapping portion is 18 mm, and the minor dimension of the openings of the non-overlapping portion is 2.2 mm.

4. The vibratory apparatus of claim 1, wherein the overlapping portion of at least one of the deck sections is planar and the non-overlapping portion of the at least one of the deck sections is planar, and the overlapping portion extends at an angle to a plane in which the non-overlapping portion is disposed.

5. The vibratory apparatus according to claim 4, wherein the angle is an acute angle.

6. The vibratory apparatus according to claim 1, wherein the exciter has at least one motor mounted thereon with a motor axis disposed transverse to the longitudinal axis of the trough.

* * * * *